US012722763B1

(12) United States Patent
Dengel et al.

(10) Patent No.: US 12,722,763 B1
(45) Date of Patent: Sep. 1, 2026

(54) SYSTEMS AND METHODS FOR AUTOMATICALLY DRAINING MARINE DRIVES AT MULTIPLE TRIM ANGLES

(71) Applicant: Brunswick Corporation, Mettawa, IL (US)

(72) Inventors: Michael P. Dengel, Malone, WI (US); Christopher J. Van Dyke, Oshkosh, WI (US); Lance W. Ziemer, Van Dyne, WI (US)

(73) Assignee: Brunswick Corporation, Mettawa, IL (US)

( * ) Notice: Subject to any disclaimer, the term of this patent is extended or adjusted under 35 U.S.C. 154(b) by 120 days.

(21) Appl. No.: 18/601,504

(22) Filed: Mar. 11, 2024

(51) Int. Cl.

| | |
|---|---|
| ***B63H 20/28*** | (2006.01) |
| ***B63B 49/00*** | (2006.01) |
| ***B63B 79/10*** | (2020.01) |
| ***B63B 79/40*** | (2020.01) |
| ***B63H 20/10*** | (2006.01) |

(52) U.S. Cl.
CPC ..... *B63H 20/28* (2013.01); *B63B 49/00* (2013.01); *B63B 79/10* (2020.01); *B63B 79/40* (2020.01); *B63H 20/10* (2013.01)

(58) Field of Classification Search
CPC ..... B63H 20/28; B63H 20/10; B63B 79/40; B63B 79/10; B63B 49/00
USPC ..... 701/21
See application file for complete search history.

(56) References Cited

U.S. PATENT DOCUMENTS 5,113,780 A * 5/1992 Bennett ..... B63B 39/061 114/286
8,216,007 B2 * 7/2012 Moore ..... B63B 39/03 440/61 T
8,261,682 B1 * 9/2012 DeVito ..... G05D 1/0875 701/21
9,290,252 B1 * 3/2016 Tuchscherer ..... B63H 20/08
10,137,971 B2 * 11/2018 Andrasko ..... B63H 20/10
12,384,495 B2 * 8/2025 Gai ..... B63H 20/106
12,397,890 B1 * 8/2025 Anderson ..... B63B 79/40

OTHER PUBLICATIONS

Mike Smedley (Old School Stripers)."How to 'Quick-Winterize' Your BOAT and MOTOR between Trips. Short-Term." YouTube, YouTube, Dec. 26, 2019, www.youtube.com/watch?v=G7gololIr-U. (Year: 2019).*
Wicked Outdoor Adventures. "Keep your Outboard Lower Unit from Freezing with this simple Trick." YouTube, Nov. 8, 2020, https://www.youtube.com/watch?v=H4_3LV8uPf0. (Year: 2020).*

* cited by examiner

*Primary Examiner* — Peter D Nolan
*Assistant Examiner* — Hyang Ahn
(74) *Attorney, Agent, or Firm* — Andrus Intellectual Property Law, LLP

(57) ABSTRACT

A method for draining a marine drive at a plurality of preset trim angles less than a fully trimmed out angle is disclosed. The method includes receiving via a controller a request to drain the marine drive and operating a trim actuator via the controller to change a trim angle of the marine drive to a first trim angle among the plurality of preset trim angles. The method further includes waiting a first preset time after the marine drive is trimmed to the first trim angle and operating the trim actuator to change the trim angle of the marine drive to a second trim angle among the plurality of preset trim angles that is different than the first trim angle. The marine drive is configured to drain when trimmed at each of the first trim angle and the second trim angle.

14 Claims, 12 Drawing Sheets

AFT ⟷ FORE

SYSTEMS AND METHODS FOR AUTOMATICALLY DRAINING MARINE DRIVES AT MULTIPLE TRIM ANGLES

FIELD

The present disclosure relates to draining marine drives and particularly to systems and methods for automatically draining marine drives at multiple trim angles.

BACKGROUND

The following are incorporated herein by reference in entirety.

U.S. Pat. No. 11,884,374 discloses an outboard motor with a top cowl and a service lid on the top cowl that is movable into and between a closed position enclosing the powerhead compartment and an open position providing manual access to the powerhead compartment from above the outboard motor. An engine is in the powerhead compartment, wherein a peripheral gap is defined between the top cowl and the engine. A serviceable engine oil device is in the peripheral gap and is manually accessible from above the outboard motor when the service lid is in the open position. A serviceable transmission fluid device is in the peripheral gap and is manually accessible from above the outboard motor when the service lid is in the open position. A serviceable gearcase fluid device is in the peripheral gap and is manually accessible from above the outboard motor when the service lid is in the open position.

U.S. Pat. No. 10,137,971 discloses a trim control system that automatically controls trim angle of a marine propulsion device with respect to a vessel. A memory stores trim base profiles, each defining a unique relationship between vessel speed and trim angle. An input device allows selection of a base profile to specify an aggressiveness of trim angle versus vessel speed, and then optionally to further refine the aggressiveness. A controller then determines a setpoint trim angle based on a measured vessel speed. If the user has not chosen to refine the aggressiveness, the controller determines the setpoint trim angle from the selected base profile. However, if the user has chosen to refine the aggressiveness, the controller determines the setpoint trim angle from a trim sub-profile, which defines a variant of the relationship between vessel speed and trim angle defined by the selected base profile. The control system positions the propulsion device at the setpoint trim angle.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

In non-limiting examples disclosed herein, a method for draining a marine drive at a plurality of preset trim angles less than a fully trimmed out angle is disclosed. The method comprises receiving via a controller a request to drain the marine drive and operating a trim actuator via the controller to change a trim angle of the marine drive to a first trim angle among the plurality of preset trim angles. The method further comprises waiting a first preset time after the marine drive is trimmed to the first trim angle and operating the trim actuator to change the trim angle of the marine drive to a second trim angle among the plurality of preset trim angles that is different than the first trim angle. The marine drive is configured to drain when trimmed at each of the first trim angle and the second trim angle.

In certain examples, the method further comprises generating a notification for an operator to check a clearance of the marine drive and/or generating a notification before and/or during automatically changing the trim angle of the marine drive to warn an operator of the marine drive moving. In further examples, the notifications comprise audible warnings.

In certain examples, the method further comprises determining whether the marine drive is positioned in water before automatically changing the trim angle thereof.

In certain examples, a powerhead of the marine drive comprises an internal combustion engine and the method further comprises cranking the internal combustion engine for a preset crank time, while preventing the internal combustion engine from starting, to assist in draining the marine drive.

In certain examples, the method further comprises determining that the powerhead is not operating by determining that a key is in an off-position.

In certain examples, the first trim angle is approximately ±2° relative to a horizontal axis, wherein the fully trimmed out angle is a positive angle greater than 2° relative to the horizontal axis, and wherein the second trim angle is a negative angle less than −2° relative to the horizontal axis.

In certain examples, the method further comprises waiting a second preset time after the marine drive is trimmed to the second trim angle and subsequently operating the trim actuator to change the trim angle of the marine drive to the fully trimmed out angle for storage.

In certain examples, the trim angle of the marine drive is changeable between the fully trimmed out angle and a fully tucked angle, wherein the first trim angle is approximately ±2° relative to a horizontal axis, the second trim angle is the fully tucked angle and is less than −2° relative to the horizontal axis, and the third preset trim angle is greater than 2° relative to the horizontal axis.

In certain examples, the first preset time is at least 1 minute.

In certain examples, the marine drive is coupled to a marine vessel and the method further comprises determining a vessel angle of the marine vessel and operating the trim actuator to accommodate for the vessel angle when changing the trim angle of the marine drive.

In certain examples, the method further comprises monitoring the change of the trim angle and, when the trim angle stops changing before the marine drive reaches the first preset trim angle for at least a threshold time, ceasing to change the trim angle to prevent damage.

In certain examples, the controller is configured to receive the request to drain the marine drive via an operator input.

In non-limiting examples disclosed herein, a method is disclosed for draining a marine drive when not in operation. The method comprises determining that a powerhead of the marine drive is not operating, receiving signal corresponding to an air temperature and/or a water temperature, and comparing the signal to a temperature threshold via a controller and, when the signal is less than the temperature threshold, generating a notification to change a trim angle of the marine drive to a preset trim angle and/or automatically changing the trim angle of the marine drive to a preset trim angle, the preset trim angle corresponding to the trim angle at which coolant is configured to drain from the marine drive.

In certain examples, the temperature threshold is greater than 0° C. and less than 5° C.

In certain examples, the preset trim angle is a first preset angle and the controller automatically trims the marine drive to the first preset trim angle when the signal is less than the temperature threshold, further comprising automatically changing the trim angle of the marine drive to a second preset trim angle that is different than the first preset trim angle after the marine drive stops at the first preset angle.

In certain examples, the controller is configured to wait a first preset time after the marine drive stops at the first preset trim angle before automatically changing the trim angle of the marine drive to the second preset trim angle.

In certain examples, the signal corresponding to the air temperature and/or the water temperature is based at least in part on a temperature prediction.

It should be recognized that the different aspects described throughout this disclosure may be combined in different manners, including those than expressly disclosed in the provided examples, while still constituting an invention accord to the present disclosure.

Various other features, objects and advantages of the disclosure will be made apparent from the following description taken together with the drawings.

BRIEF DESCRIPTION OF THE DRAWINGS

Examples are described with reference to the following drawing figures. The same numbers are used throughout to reference like features and components.

DETAILED DESCRIPTION OF THE DRAWINGS

Figure 1:
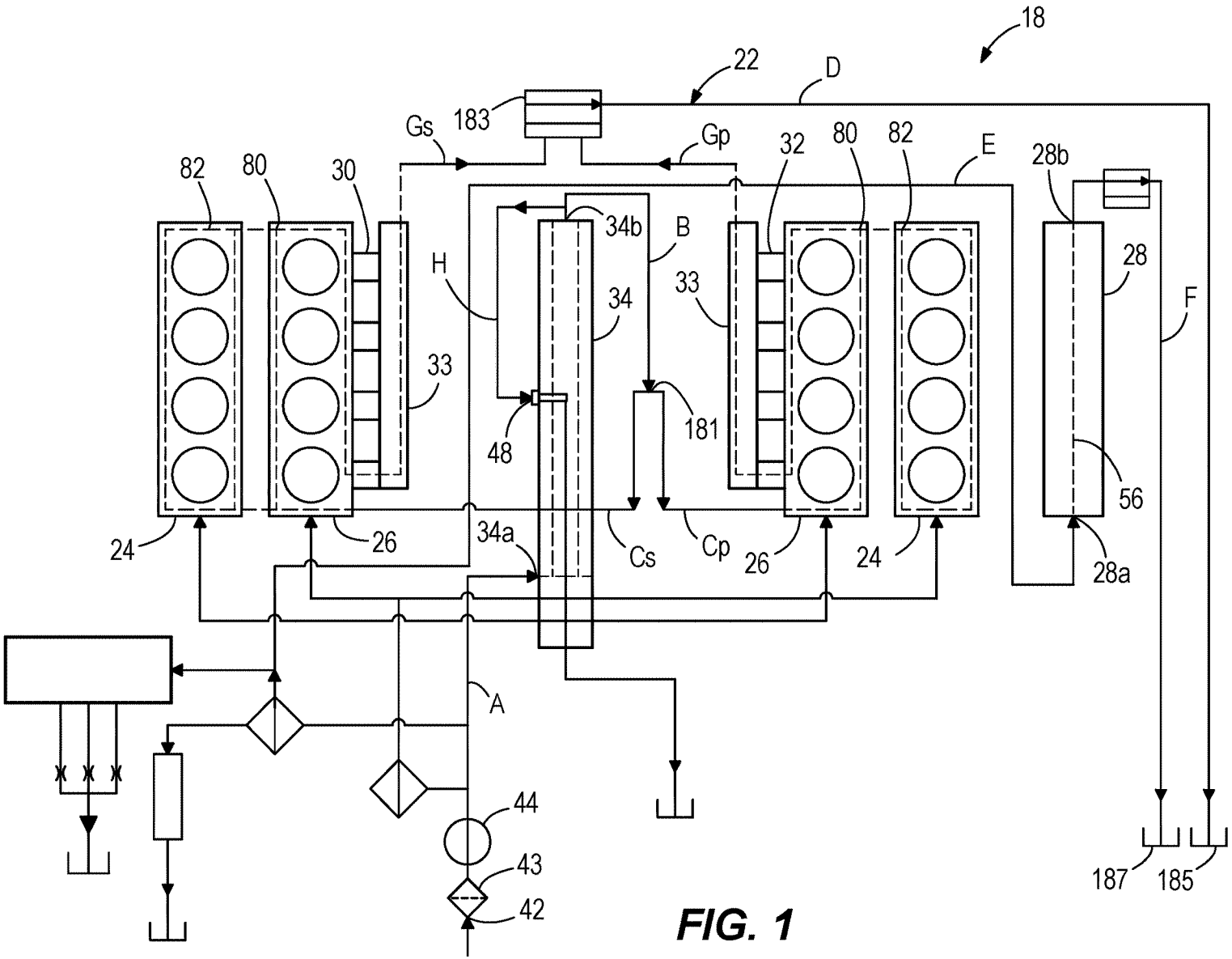
FIG. 1 is a schematic view of a first embodiment of a cooling system for a marine engine according to the present disclosure.

The present disclosure generally relates to marine drives, and particularly systems and methods for assisting in the process of draining coolant from marine drives having complicated coolant systems and corresponding drainage needs. Marine drives, whether outboards, stern drives, or other types of marine drives, typically use water from the body of water in which a marine vessel is operated as a coolant during operation. The water is drawn into the marine drive, flows through various circuits to cool different components of the marine drive (e.g., powerheads, exhaust manifolds, etc., as discussed further below), and is returned to the body of water after having removed some portion of heat from the marine drive.

The vast majority of marine drives are self-draining, meaning that the water drawn into the marine drive as coolant automatically drains by virtue of gravity (e.g., when left at level trim or 0° trim angle). However, some marine drives are not self-draining. In these cases, once water has been drawn into the marine drive, some portion of this water remains therein even when the marine drive is not being operated. As such, this water needs to be drained out before the marine drive is exposed to freezing temperatures to avoid the risk of this water freezing and causing damage within the marine drive and/or other components.

However, draining these non-self-draining marine drives is not simply a matter of positioning them at a different trim angle than level trim (e.g., at a 10° trim angle). Depending on the trim angle of the marine drive, pooling can occur in the various coolant circuits, meaning that water remains within the circuit rather than draining out by the force of gravity. For example, at a given trim angle, a particular coolant circuit may be oriented so as to function similarly to a conventional "P-trap" used in household plumbing. However, unlike in household plumbing, this pooling is not intended, and further creates a risk of damage if exposed to freezing conditions while water remains pooled. By way of non-limiting example, some pooling positions PP are shown for the cooling systems shown in FIGS. 4-6. However, it should be recognized that these will vary by marine drive and cooling system configurations. Accordingly, certain marine drives must be drained at multiple specific trim angles, each for a minimum time sufficiently long to allow the water to fully drain, and in certain cases preferably or necessarily in a particular sequence such that the water is progressively drained out of the marine drive (i.e., rather than ending up pooled in one area after draining from another).

The present inventors have recognized that this process is time intensive, requires particular knowledge of the specific trim angles required, times required, and sequences for draining. For example, one V10 outboard marine drive presently known in the art has a recommended drain procedure as follows: 1) level trim (approximately 0° trim angle) for at least 5 minutes to drain the powerhead and the crankcase oil cooler, 2) "full tuck" (approximately −14° trim angle) for at least 1 minute to drain the exhaust sprayer, head, and block, and finally 3) a trimmed out position used for storage (e.g., 30° trim angle). The particular trim angles corresponding to full tuck, a tuck angle for draining, full trim, and a trim angle for draining may vary by marine drive. By way of example, other marine drives may require a tuck position of −2° trim angle or less and a trim position of 2° trim angle and/or more for draining, which may also require a level trim beyond these. Likewise, multiple trim or tuck positions may be required (e.g., −10° trim angle, 5° trim angle, and 25° trim angle). As discussed above, failure to follow these steps can result in damage to the engine or other components if freezing occurs.

Moreover, systems and methods presently known in the art require the user to guess the trim angle of the marine drive as the trim actuators are manually controlled, resulting in inaccurate orientations and thus no or inferior draining even when the user does know what parameters are intended. As such, systems and methods known in the art are prone to errors, prone to being skipped, and also detract from the user experience in the overall process of operating a marine vessel. Accordingly, through experimentation and development, the present inventors have developed the presently disclosed systems and methods for ensuring that marine drives are properly drained despite the complex requirements in achieving this need. Although the presently disclosed systems and methods may be especially advantageous for draining marine drives having complex requirements, benefits are also provided for use with simpler configurations, including marine drives considered to be self-draining when at level trim, as discussed further below.

It should be recognized that although some of the follow examples focus on marine drives having an internal combustion engine (ICE) as the powerhead, the present disclosure also contemplates drainage for other types of marine drives, including those using electric motors for powerheads. Additionally, the present disclosure contemplates applications in which multiple marine drives are controlled to be drained, which may have different requirements and thus follow different automatic draining procedures. For example, the different marine drives may have different specific trim angles, drain times, and/or sequences that must be followed, further complicating the process for the user in manually draining these marine drives. For brevity, the present disclosure largely focuses on an example of draining a single marine drive.

Figure 2:
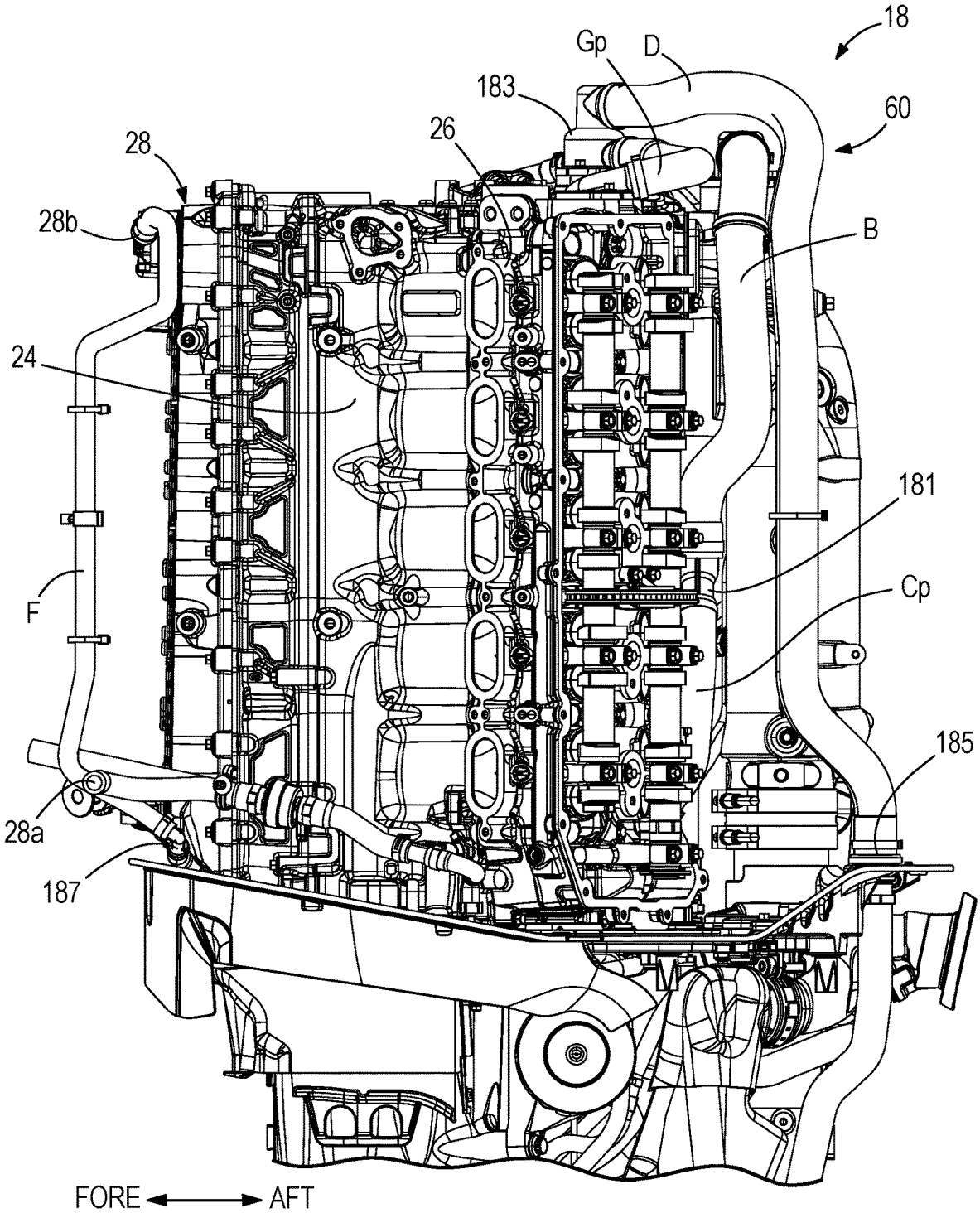
FIG. 2 is a port side view of the marine engine showing cooling pathways.
Figure 3:
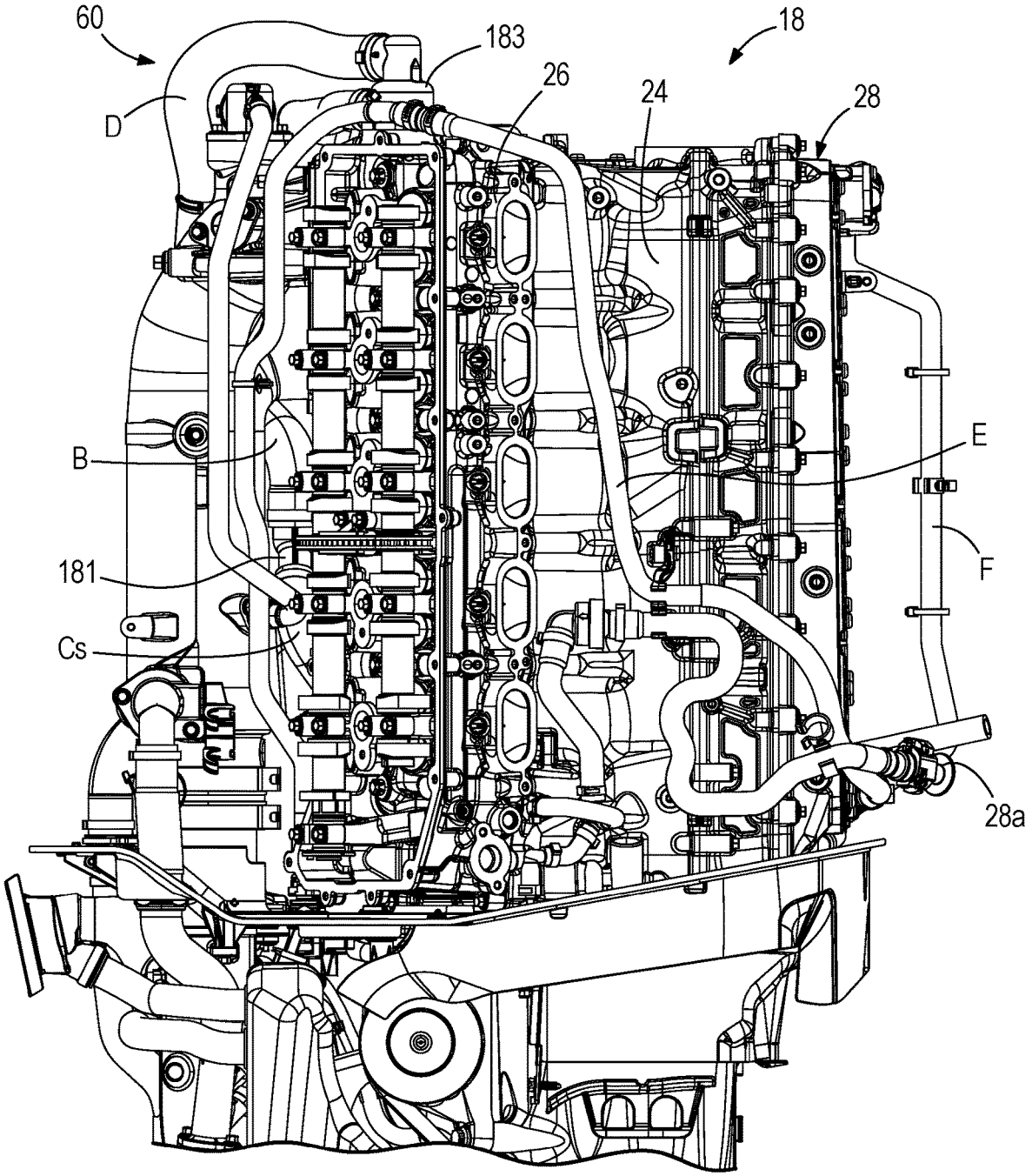
FIG. 3 is a starboard side view of the marine engine showing cooling pathways.

FIG. 1 depicts a cooling schematic for a powerhead 18 and marine drive more generally, whereby port and starboard side views are also provided in FIGS. 2 and 3. The powerhead 18 is for use in an outboard motor, although the concepts of the present disclosure are not limited for use with outboard motors. The powerhead 18 has a cooling system 22 for cooling various components of the powerhead 18 as will be described further herein. The powerhead 18 includes, among other things, an engine block 24 and engine heads 26. A crankcase 28 contains a crankshaft (not shown). An exhaust conduit 34 conveys exhaust gas from the powerhead 18 for discharge to atmosphere. The exhaust conduit 34 is centrally located in the valley of the V-shape and receives the exhaust gas from the first and second banks of cylinders 30, 32 via exhaust manifolds 33 on the engine heads 26. Via these and other components, the powerhead 18 discharges the exhaust gas to an underwater outlet combustion process in the powerhead 18 causes rotation of the noted crankshaft, which in turn causes rotation of a corresponding driveshaft, propeller shaft, and propeller configured to propel a marine vessel in water, all as is conventional. The above-incorporated U.S. Pat. No. 9,616,987 discloses examples of this type of arrangement in more detail. The marine engine further includes a controller 105 (FIG. 9, discussed below) within a control system 100 for controlling various operations of the marine engine and the cooling system 22.

Referring to FIG. 1, the schematic of the powerhead 18 shows a variety of cooling circuits or pathways associated with the marine drive 20. The cooling system 22 includes several conduits (shown in solid lines) and passages (shown in dashed lines) for conveying cooling water from the body of water in which the outboard motor is operating to the powerhead 18 for cooling various components thereof, and then back to the body of water. The cooling system 22 includes an underwater inlet 42 which is located on a lower gearcase of the outboard motor or any other location that is under water during normal operation of the outboard motor. A conventional mechanical or electric pump 44 is configured to draw the cooling water into the outboard motor via the underwater inlet 42, through a screen 43 and/or similar filtering apparatus. The pump 44 is configured to pump the cooling water through a series of cooling conduits and/or passages, including hoses, cooling jackets, and/or lines. The cooling system 22 further conveys the cooling water upwardly into and alongside the exhaust conduit 34. In particular, the cooling water is conveyed through a cooling jacket on the exhaust conduit 34 and a portion of the cooling water is sprayed into the exhaust gas conveyed through the exhaust conduit 34 via cooling water sprayers 48, all as is disclosed for example in U.S. Pat. No. 10,233,818, which is incorporated by reference in its entirety herein.

From the cooling jacket on the exhaust conduit 34, the cooling water is conveyed to a split junction 181 through which the cooling water is conveyed to the engine heads and blocks 24, 26 on both the port and starboard side of the engine. From the split pathway, the cooling water is conveyed to cooling passages 80, 82 in the engine heads 26 and engine block 24, for example as is disclosed U.S. Pat. No. 9,365,274, which is incorporated by reference in its entirety herein. From the engine heads 26, the cooling water is conveyed upwardly through cooling jackets on exhaust manifolds 33 that convey the exhaust gas from the engine heads 26 to the exhaust conduit 34. From a cooling perspective, the exhaust conduit 34 may also be referred to as an exhaust sprayer with respect to the cooling functionality of the coolant water passing therethrough. The cooling water is then conveyed upwardly to a powerhead drain outlet 183, which will be discussed further herein.

The cooling system 22 also conveys the cooling water to the crankcase 28 and then through a cooling passage 56 in the crankcase 28, particularly for cooling the crankcase 28 and particularly for cooling lubricant (e.g., oil) contained within the crankcase 28. Therefore, from a cooling perspective, the crankcase 28 may also be referred to as a crankcase oil cooler. Conveyance means for the cooling water is shown via solid lines representing conduits such as for example hoses/tubes and dashed lines representing passages such as defined by a cooling jacket.

The cooling system 22 further includes a plurality of auxiliary cooling pathways, which will be described further herein in relation to the engine cooling pathways with which they are connected. The auxiliary cooling pathways provide means for conveyance of the cooling water between elements of the marine drive as well as pathways for drainage of cooling water from the marine drive. As discussed above, during periods of non-use of the marine drive, cooling water which remains within the auxiliary cooling pathways and engine cooling pathways can pool at junctions, bends, and/or the like, which can create problems with extended non-use or during extreme temperature events. Current marine drive systems require that a user manually manipulates a trim and tuck angle of the marine drive to initiate the drainage of these pathways and prevent pooling which can lead to damage of the cooling system and the marine drive.

In the event that a user forgets or otherwise does not manually execute this process (e.g., including being aware of an unseasonable cold snap coming), or fails to trim and tuck the marine drive to the appropriate angles for the appropriate duration of time, cooling water can remain within the cooling system and cause damage to the marine drive. During research and testing, the present inventors identified a need for improved control systems which are able to detect a need for and execute automatic, timed, sequential trimming and tucking of the marine drive in order to drain remaining cooling water from the cooling pathways. The present disclosure provides an improved control system and method for automatically draining cooling water from cooling pathways within marine drives.

Referring now to FIG. 1 in conjunction with FIGS. 2-6, auxiliary cooling pathways 60 (also referred to as cooling circuits or conduits) are shown. A cooling pathway A conveys water from the pump 44 to an inlet 34*a* of the exhaust conduit 34. The cooling water is conveyed through a cooling jacket of the exhaust conduit 34 and to an outlet 34*b*. A cooling pathway B extends from the outlet 34*b* toward the split junction 181. The split junction 181 separates into cooling pathways $C_P$ and $C_S$. The cooling pathway $C_P$ conveys the cooling water to the port heads 26 and blocks 24 and the cooling pathway $C_S$ conveys water to the starboard heads 26 and blocks 24. The cooling water is conveyed through the heads 26, blocks 24, and exhaust manifolds 33 on both the port and the starboard side and exit into cooling pathways $G_P$ and $G_S$ which converge to the powerhead drain outlet 183. The powerhead drain outlet 183 is further connected to a drainage pathway D which leads to a drain outlet 185. A cooling pathway E extends from the powerhead drain outlet 183 to an inlet 28*a* of the crankcase 28. A cooling pathway F extends from an outlet 28*b* of the crankcase 28 and toward a drain 187. Finally, a cooling pathway H extends from the outlet 34*b* of the exhaust manifold to the cooling water sprayer 48. Different temperature sensors may be positioned to measure the temperatures of these various components and/or the coolant circulating therethrough (e.g., element 151 in FIG. 9). Additionally, or alternatively, a temperature sensor may be positioned to measure an ambient temperature, for example to determine when conditions are approaching freezing temperatures, discussed further below.

Within each of the cooling pathways A, B, $C_P$, $C_S$, D, E, F, $G_P$, $G_S$, and H, as well as other various pathways which are not described herein, are potential pooling areas within which cooling water can reside. Each of these potential pooling areas can be drained by trimming or tucking the marine drive to a specific angle for a specific duration of time, as will be discussed further herein.

Figure 9:
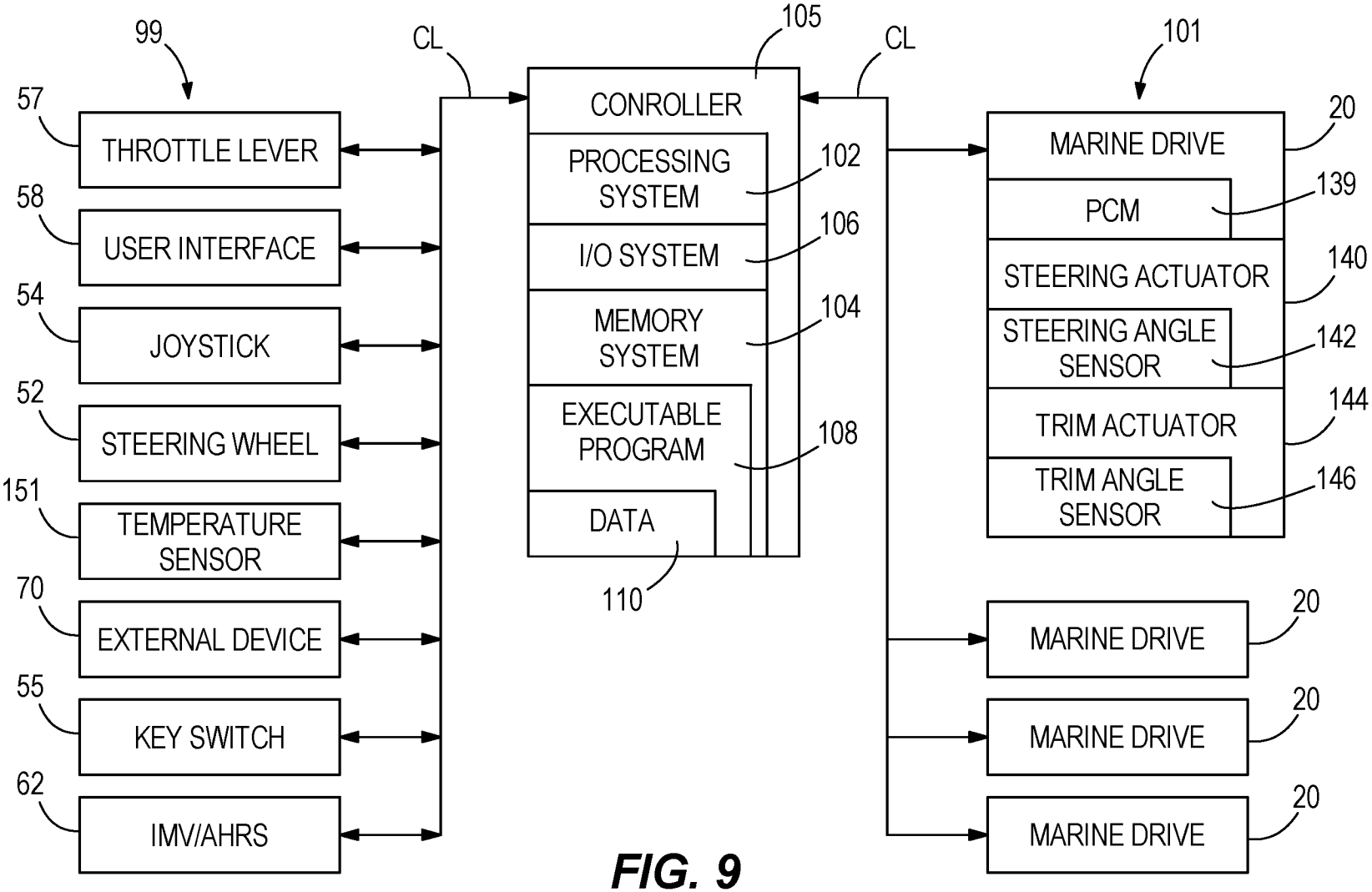
FIG. 9 is a schematic view of a control system of the present disclosure.

With reference to FIG. 9, the marine drives may be trimmed and tucked using conventional trim actuators 144, which may be hydraulically, pneumatically, and/or electromechanically operated. The trim actuators 144 may also have trim angle sensors 146 provided therewith so as to measure an actual trim angle of the corresponding marine drive. Additional information regarding exemplary trim actuators is provided in U.S. Pat. Nos. 6,583,728; 7,156,709; 7,416,456; and 9,359,057, which are incorporated by reference herein.

With continued reference to FIG. 9, additional information is now provided for an example of the control system 100 such as may be incorporated within the marine drive of FIG. 1. Certain examples of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

In certain examples, the control system 100 communicates with each of the one or more components via a communication link CL, which can be any wired or wireless link. The control system 100 is capable of receiving information and/or controlling one or more operational characteristics of the various sub-systems by sending and receiving control signals via the communication links CL. In one example, the communication link CL is a controller area network (CAN) bus; however, other types of links could be used. It will be recognized that the extent of connections and the communication links CL may in fact be one or more shared connections, or links, among some or all of the components. Moreover, the communication link CL lines are meant only to demonstrate that the various control elements are capable of communicating with one another, and do not represent actual wiring connections between the various elements, nor do they represent the only paths of communication between the components. Additionally, the control system 100 may incorporate various types of communication devices and systems, and thus the illustrated communication links CL may in fact represent various different types of wireless and/or wired data communication systems.

The control system 100 may be a computing system that includes the controller 105 having a processing system 102, memory system 104, and input/output (I/O) system 106 for communicating with other devices, such as input devices 99 and output devices 101. The controller 105 may be a singe controller, or may be a combination of multiple controllers, such as a central controller, a battery controller, a propulsion control module 139, and one or more motor controllers, trim controllers, steering controllers, etc. The different controllers may be communicatively connected via communication links CL, which may be as a communication bus such as a CAN bus or a LIN bus, or by single dedicated communication links between components. A person of ordinary skill in the art will understand in view of the present disclosure that other control arrangements could be implemented and are within the scope of the present disclosure, and that the control functions described herein may be combined into a single controller or divided into any number of a plurality of distributed controllers that are communicatively connected.

Examples of input devices 99 within the control system 100 include but are not limited to a throttle lever 57, a user interface 58 (e.g., a graphical user interface on a touchscreen display device), a joystick 54, a key switch 55, a steering wheel 52, a temperature sensor 151, or an external device 70 such as a smartphone or tablet that wirelessly communicates with the marine vessel via a conventional mechanism. It should be recognized that other input devices may also be provided, such as keyboards, trackpads, roller balls, and the like. In various embodiments, the display device 58 may be, for example, part of an onboard management system, such as the Vessel View™ by Mercury Marine of Fond du Lac, Wisconsin. Additionally, or alternatively, the external device 70 may be configured to operate an application such as the "Mercury Marine" App or the Vessel View™ Mobile App each provided by Mercury Marine of Fond du Lac, Wisconsin. In each case, the applications allow the user to receive information and to provide input commands to the control system 100 and also to convey information as an output thereof. In this manner, the external device 70 may also constitute a controller within the control system 100.

With continued reference to FIG. 9, the processing system 102 loads and executes an executable program 108 from the memory system 104, accesses data 110 stored within the memory system 104, and directs the marine vessel generally to operate as described in further detail below. The processing system 102 may be implemented as a single microprocessor or other circuitry or be distributed across multiple processing devices or sub-systems that cooperate to execute the executable program 108 from the memory system 104. Non-limiting examples of the processing system include general purpose central processing units, application specific processors, and logic devices.

The memory system 104 may comprise any storage media readable by the processing system 102 and capable of storing the executable program 108 and/or data 110. Temperature thresholds for comparing to measurements from the various temperature sensors 151 may be stored in the data 110 (e.g., a threshold greater than 0° C. and less than 5° C. to effectuate draining before freezing occurs). The memory system 104 may be implemented as a single storage device or be distributed across multiple storage devices or sub-systems that cooperate to store computer readable instructions, data structures, program modules, or other data. The memory system 104 may include volatile and/or non-volatile systems and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

The control system 100 may also control other components, such as a steering actuator 140 and associated steering angle sensor 142, and a trim actuator 144 and trim angle sensor 146, or temperature sensor 151, each of which may be conventional and is thus not described further herein. The control system 100 also may also control the operation of other notification devices (e.g., display screens, speakers, buzzers, vibration devices), an external device 70, and/or the user interface 58.

As described above, the controller 105 is configured to communicate with a variety of sensors and inputs for the marine drive. The present inventors have developed a method of determining a need for and automatically initiating a draining cycle for the one or more marine drives operatively connected thereto based upon sensed inputs, which may include temperature readings, user input selections, etc. For example, the process may begin automatically when the ambient temperature of the marine vessel is measured to be less than 5° C., or when triggered via user selection through the user interface 58. In certain embodiments, the process also waits until the marine vessel has been keyed off for a predetermined amount of time (e.g., 5 hours), which may be determined in a conventional method (e.g., detected by the one/off state of a conventional key switch 55). In another embodiment, the process confirms that the powerhead of the marine drive is measured to not be operating (e.g., 0 RPM as measured by conventional sensors such as hall effect sensors, discussed further below), and in further embodiments not operating for a threshold time. The system can remain powered to perform this counting of elapsed time in a similar manner as key off timers for propulsion systems presently known in the art. For example, Mercury Marine propulsion systems with drive by wire marine drives have a feature known as "trim with key off (TKO)", which keeps the PCM of a marine drive powered for up to 15 minutes after the key is turned off such that the operator may adjust the trim during that time. A window control in an automobile may work in a similar manner, maintaining power for a predetermined duration after being keyed off to allow the operator to roll the windows up.

Figure 4:
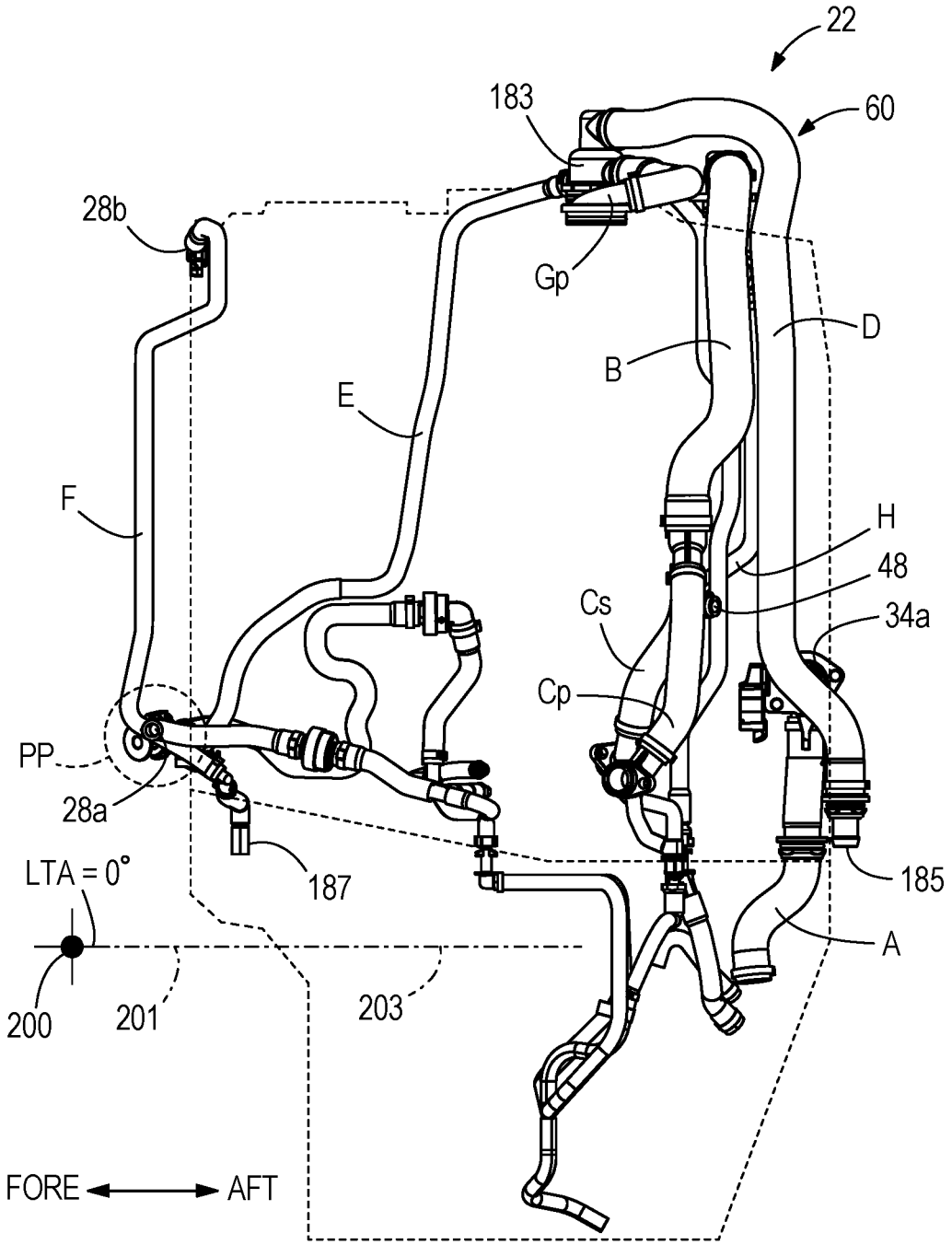
FIG. 4 is a view of the cooling system specifically showing cooling pathways according to the present disclosure.
Figure 5:
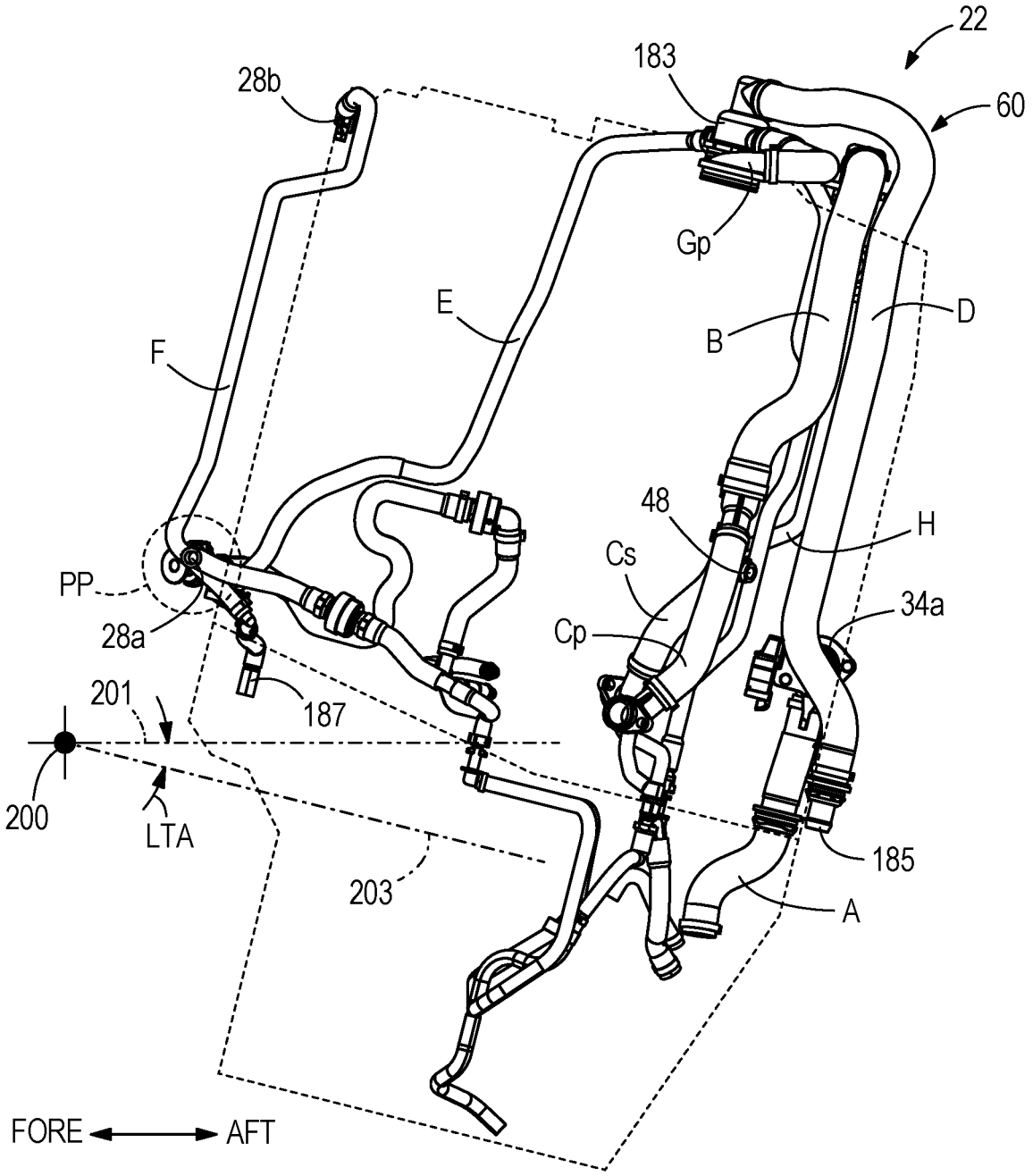
FIG. 5 is a view of the cooling system in a tucked configuration.
Figure 6:
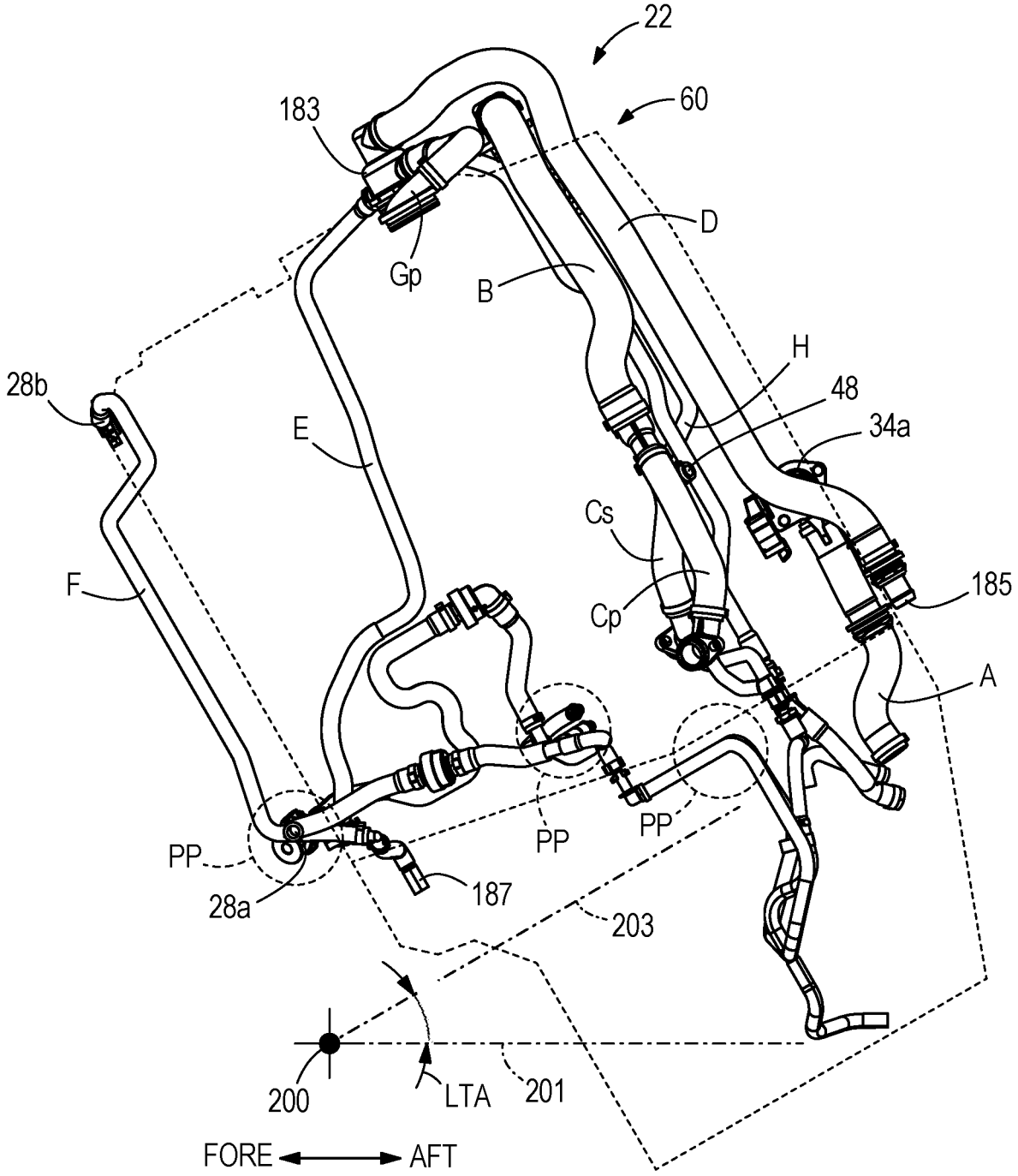
FIG. 6 is a view of the cooling system in a trimmed configuration.
Figure 8:
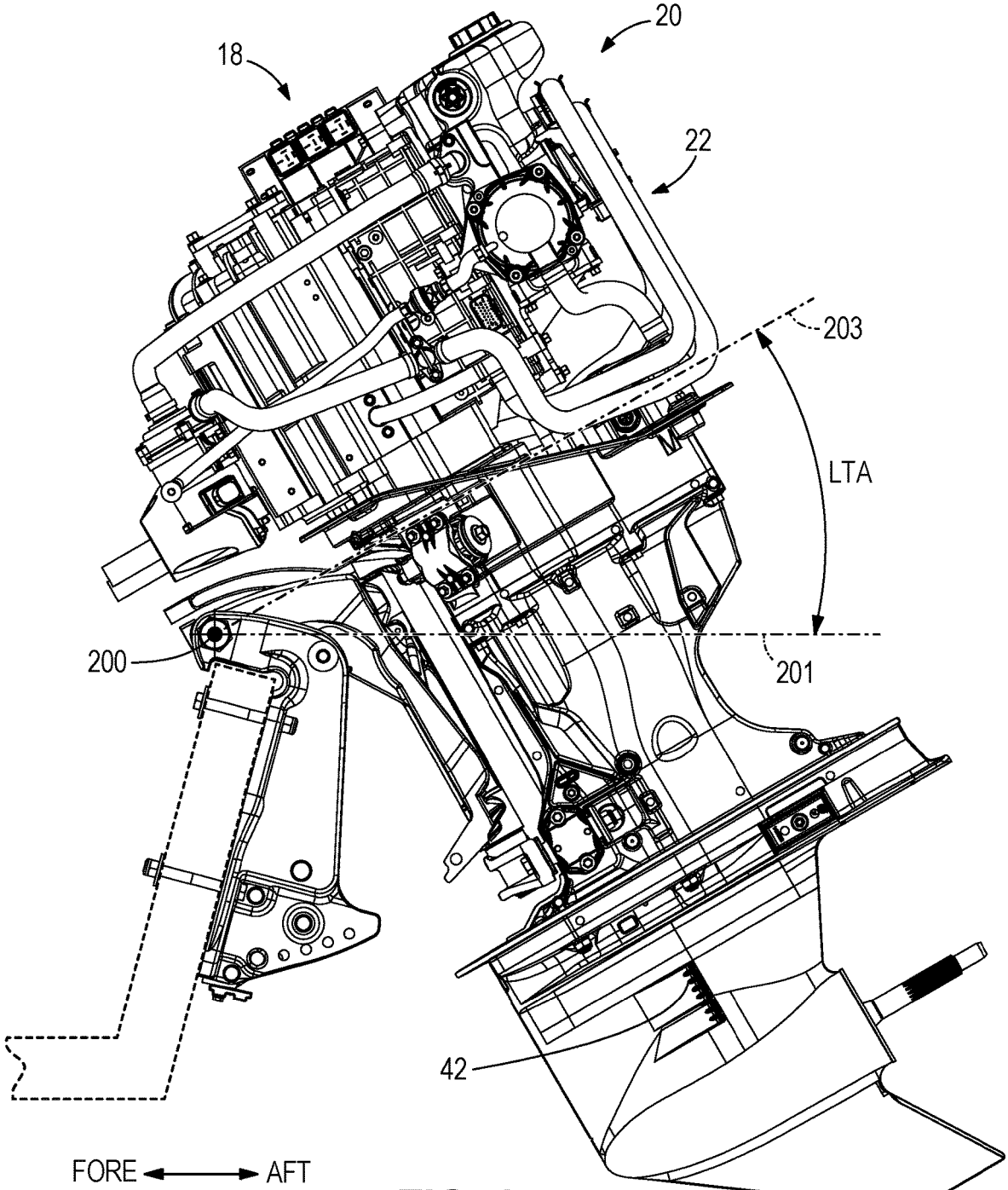
FIG. 8 is a view of the marine drive at a second preset trim angle.

Referring to FIGS. 4-6 the marine drive 20 is shown in various trim angles TA between a horizontal axis 201 and a plane 203 through the marine drive 20 as the marine drive pivots about a trim axis 200. The plane 203 is defined through the marine drive 20 so as to be parallel to the horizontal axis 201 (e.g., a trim angle TA of 0°, for example being parallel to a conventionally mounted anti-ventilation plate as shown in FIGS. 8 and 9) when the marine drive is at "level trim" (see FIG. 4). The marine drive 20 can be trimmed with respect to the trim axis 200 to a plurality of preset trim angles via controlling operation of the trim actuators 144, as discussed above. For the purposes of the disclosure, the term "trimmed," will be used in reference to configurations as shown in FIG. 6, where the marine drive 20 is oriented at a positive trim angle above the axis 201. A trim angle of the marine drive 20 is changeable between a fully trimmed out angle and a fully tucked angle. The marine drive 20 is considered to be at a "fully trimmed out angle," when the marine drive 20 is oriented at the greatest positive trim angle TA in which it is capable (see FIG. 6), which by way of example is at least greater than 2° above the horizontal axis 201. The marine drive 20 is considered to be at a "fully tucked in" angle when oriented at the most negative trim angle TA in which it is capable (see FIG. 5), which by way of example is at least −2° below the horizontal axis 201.

The marine drive 20 can further be trimmed to a plurality of preset trim angles which correspond to angles which allow for drainage of the cooling water from the aforementioned pooling areas. It should be recognized that the plurality of preset trim angles will therefore range between, and may include, the fully tucked and the fully trimmed positions. The preset trim angles are stored within the memory system based on the particular marine drive to ensure that the drainage plan accounts for the particular pooling conditions thereof. As stated above, the drain procedure may therefore control multiple marine drives in differing manners.

Figure 10:
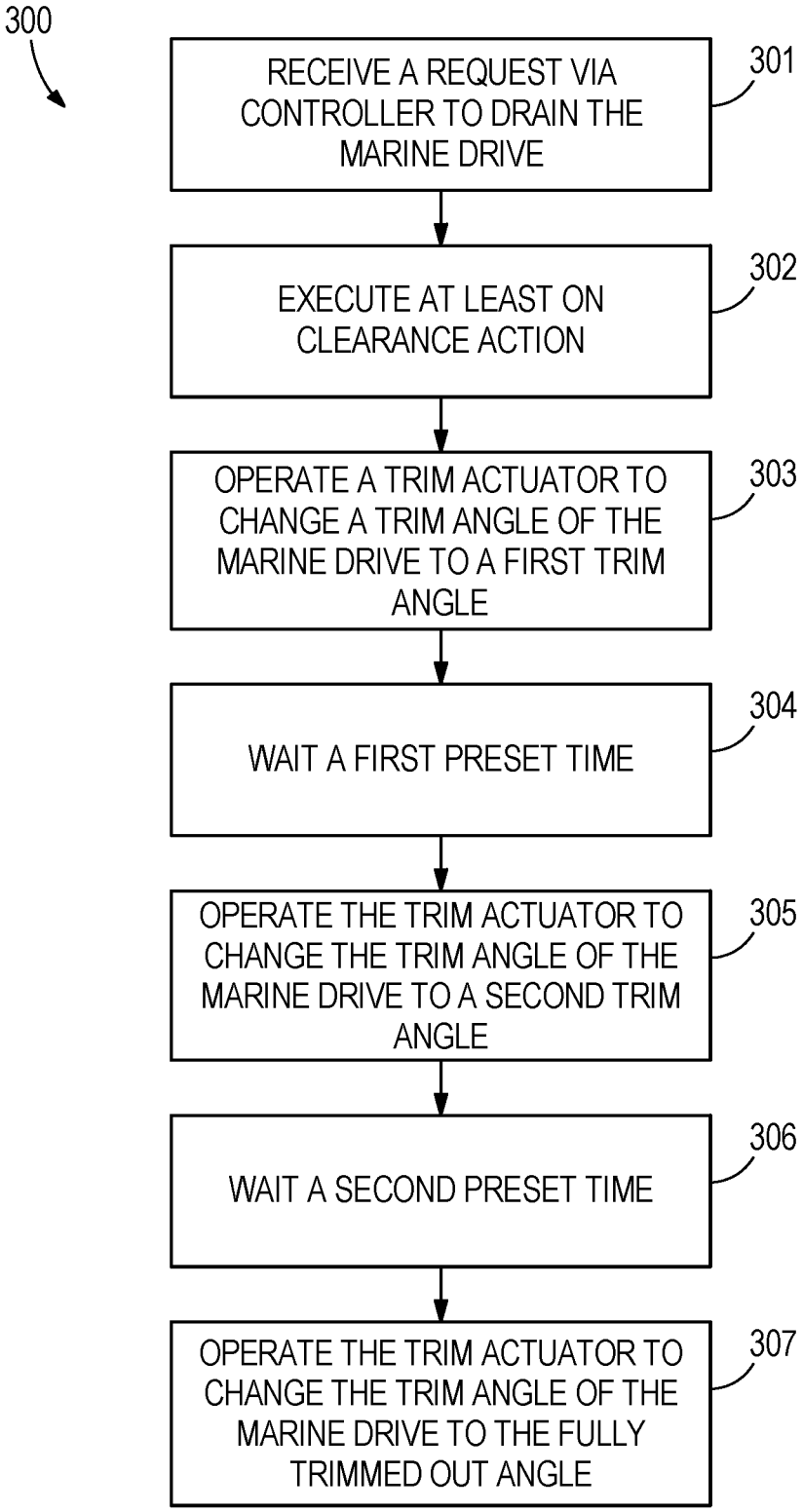
FIG. 10 is a first method of draining a cooling system according to the present disclosure.
Figure 11:
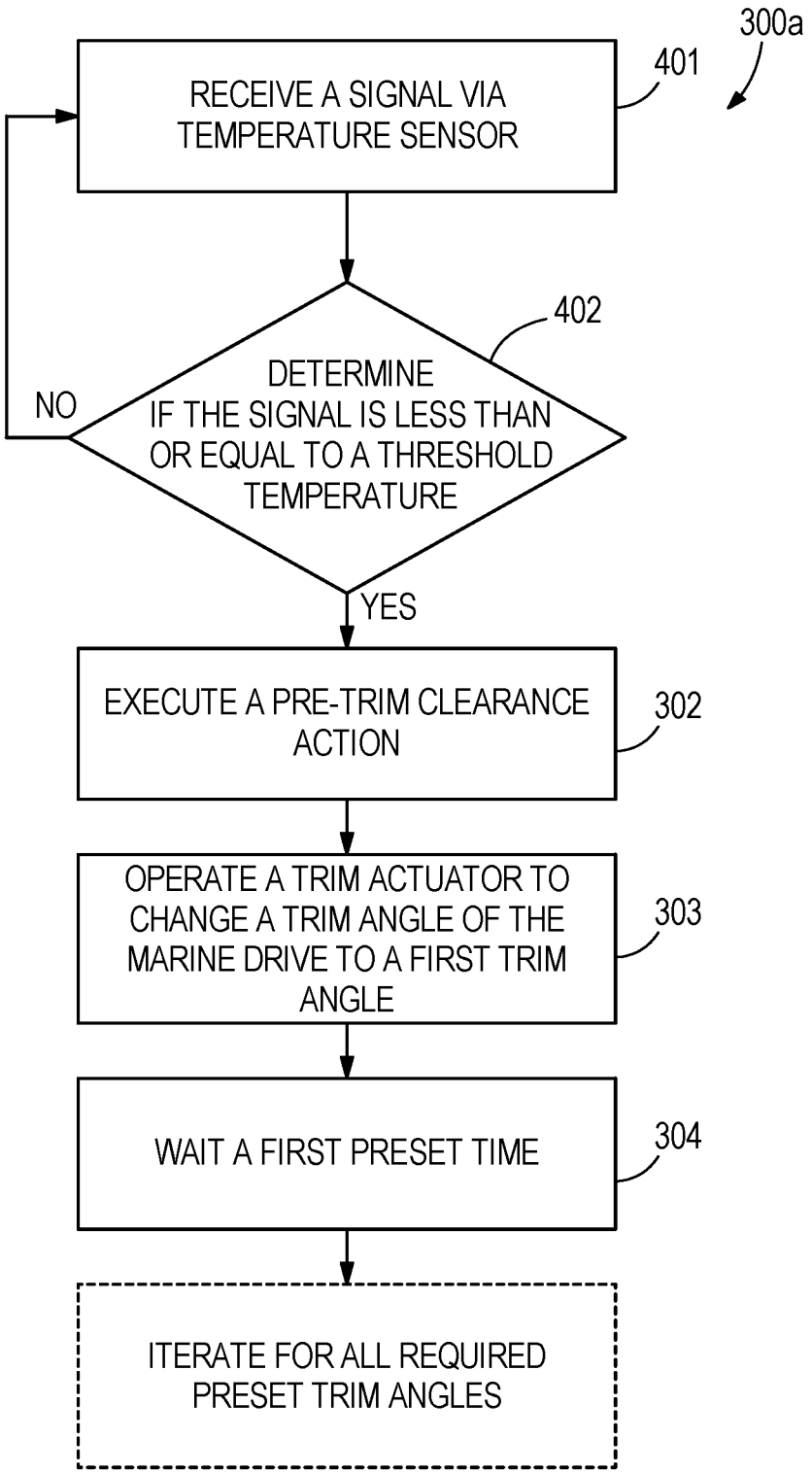
FIG. 11 is a second method of draining a cooling system according to the present disclosure.

Referring now to FIG. 10, a method 300 is shown for draining a marine drive 20 at a plurality of preset trim angles less than a fully trimmed out angle. In other words, the method 300 provides for draining marine drives that are not self-draining, but require draining at multiple angles other than simply full trim (storage) and level trim. The control system 100 receives a request via the controller 105 to drain the marine drive 20 at step 301. The request to drain the marine drive 20 may be manually input by a user via the user interface 58, or automatically initiated via the controller 105. In certain embodiments, shown in FIG. 11, at step 401, the controller 105 is configured to receive a signal corresponding to an air temperature and/or a water temperature via the temperature sensor 151 and compare the signal to a temperature threshold via the controller 105 at step 402.

The temperature threshold corresponds to a temperature at or below which the cooling fluid may be affected in such a way that may cause damage to the marine drive 20. For example, the temperature threshold may be a temperature that is greater than 0° C. and less than 5° C. to correspond to a temperature at which the cooling water would freeze and expand within the cooling pathways 60. In certain embodiments, the signal corresponding to the air temperature and/or the water temperature is based at least in part on a temperature prediction. For example, the temperature may be received by the controller 105 from a weather app running on an external device 70, whereby the trim procedure is automatically started when the weather forecast indicates a temperature overnight that will cross a temperature threshold as discussed above. In certain examples, the controller 105 will also wait until the key switch 55 has been turned to the off position for at least a threshold time before starting the drain sequence. The threshold time may vary by time of way, for example being longer during "daytime" hours from 5:00 am to 10:00 μm when the marine drive is more likely to still be in use, and as low as 0 minutes overnight from 10:00 μm to 5:00 am.

Figure 12:
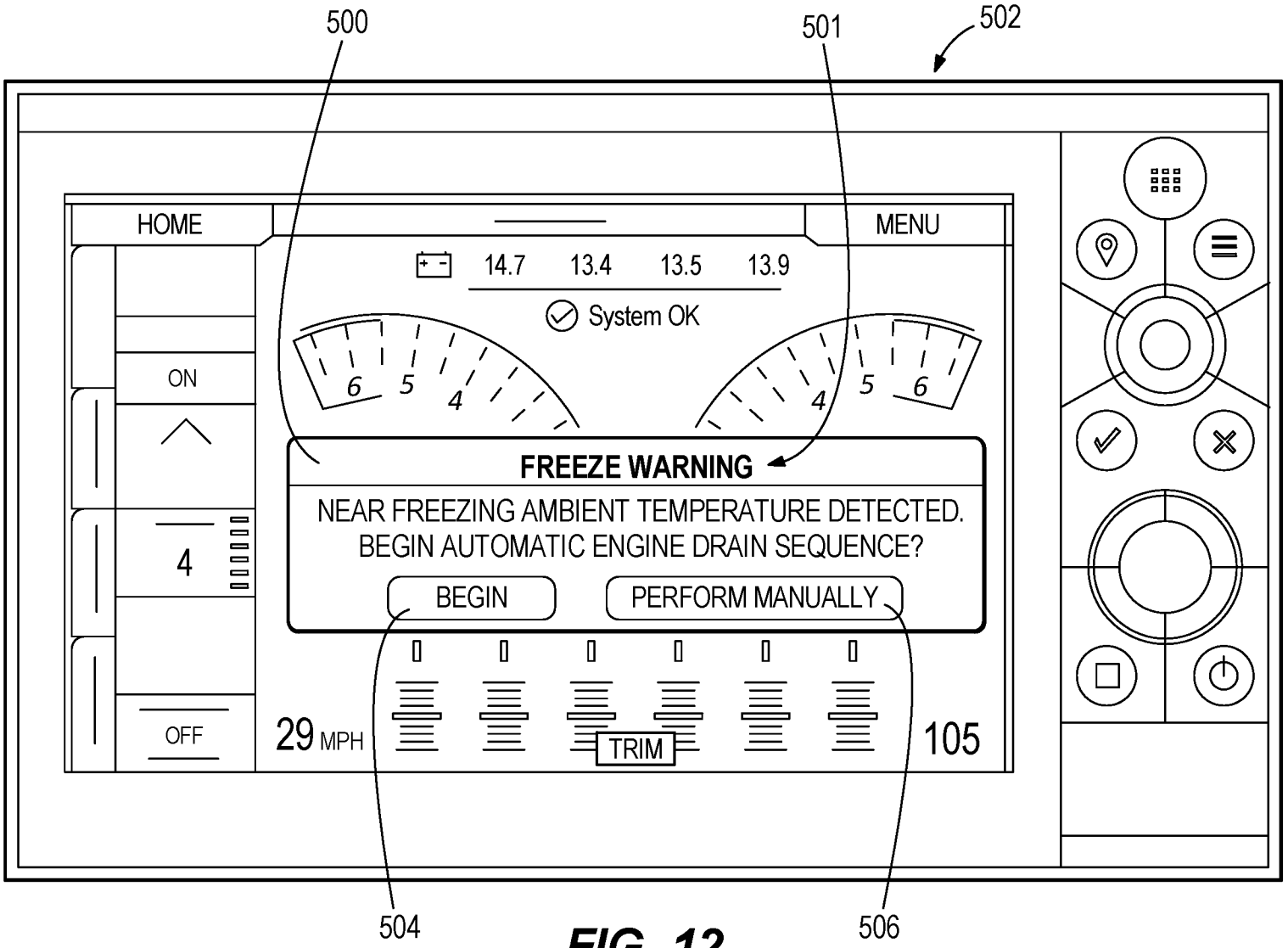
FIG. 12 depicts an example of a graphical user interface notifying a user of a need to drain a marine drive according to the present disclosure.

When the signal is determined to be less than the temperature threshold, the controller 105 is configured to generate a notification at step 403 indicating that drainage is needed. The notification may also indicate specifically that this will necessitate changing the trim angle of the marine drive, and in certain cases indicating the preset trim angles in which the marine drive must be positioned for this drainage, beginning with a first preset trim angle corresponding to the trim angle at which coolant is configured to drain from the marine drive 20. For the purposes of the disclosure, the first preset trim angle is different than the fully trimmed out angle. The notification may be provided in a number of manners, such as by displaying a notification 500 window within a graphical user interface (GUI) 502 like that shown in FIG. 12 on a user interface 58 at the helm and/or on an external device 70 (FIG. 9). In the example shown, the notification 500 includes text and/or visual information 501 notifying the user of the need to drain the marine drives, along a first selection 502 for initiating an automatic draining process according to the present disclosure and/or a second selection 504 to allow the user to manually react to the notification by manually draining the marine drive or drives. In certain embodiments, the temperature reading and/or prediction may also be displayed to assist the user in determining whether to drain the marine drive.

The notification may also or alternatively be provided via haptic outputs or audible warnings or messages, which may be responded to via button selections and/or voice commands from the user. By way of example, the controller 105 may cause the user to be asked if they would like to initiate an automatic drain procedure, then to receive the response from the user, via connected smart watch, as "Yes, perform the drain procedure" or a swipe towards yet on the smart watch. Audible warnings may also be provided before or during any change to the trim angle of the marine drive for further enhanced precaution and awareness.

Returning to FIG. 10, additional steps in the process 300 are now discussed. For brevity, it should be recognized that some of the same steps for the method 300 of FIG. 10 may be used for the method 300*a* of FIG. 11 and are thus not repeated. Upon receiving the request to drain the marine drive 20, such as to automatically drain the marine drive via the first selection 504 in the GUI 502 of FIG. 12, the controller 105 is configured to execute at step 302 any clearance actions which are stored within the control system 100. A clearance action can include but is not limited to determining a current trim angle of the marine drive 20 (e.g., via trim angle sensors 146 associated with the trim actuators 144, see FIG. 9, generating a notification for an operator to check a clearance of the marine drive 20 (e.g., that the marine drive may move between full trim and full tuck positions without obstruction), generating a notification to warn an operator of the marine drive 20 moving or moving within a predetermined amount of time (e.g., providing a visual and audible count-down of 10 seconds with an abort button provided on a touchscreen), or determining whether the marine drive 20 is positioned in water. The marine drive may be detected to be positioned in the water in a manner known in the art, such as using water sensors (e.g., as described in U.S. Patent Application Publication No. 2022/21710, which is incorporated by reference herein in its entirety). Detecting whether the marine drive is in the water may also or alternatively be used before cranking the powerhead to assist in blowing water out of the coolant system, whereby doing so while in the water would be counterproductive.

In certain embodiments, the controller 105 may further be configured to determine if the marine drive 20 is operating. This may be performed by determining whether the key switch 55 is in an off-position. Another method for determining whether the marine drive is operating is using a speed sensor 21 (FIG. 9) configured to measure a rotational speed of the powerhead, a propeller shaft rotated by the powerhead, and/or the like. The speed sensor 21 may be a Hall-Effect sensor or another rotation sensor that measures the rotational speed in rotations per minute (RPM) in a manner known in the art (e.g., using capacitive or inductive measuring techniques).

In addition to, or as an alternative to, notifying the operator before changing the trim angle of the marine drive, the clearance action may include notifying the operator of further actions associated with draining the marine drive, such as cranking an ICE powerhead for a preset crank time to further purge the marine drive of water. By way of example, the preset crank time may be 1 second, 2 seconds, or other times sufficient to purge the water from the marine drive. In this case, the control system 100 may be configured to prevent the internal combustion engine from actually starting, for example by not producing spark via the spark plugs. The present inventors have recognized that although the marine drive may be configured to not start, the method advantageously warns the operator so as to avoid starting them or causing any unnecessary concern.

Figure 7:
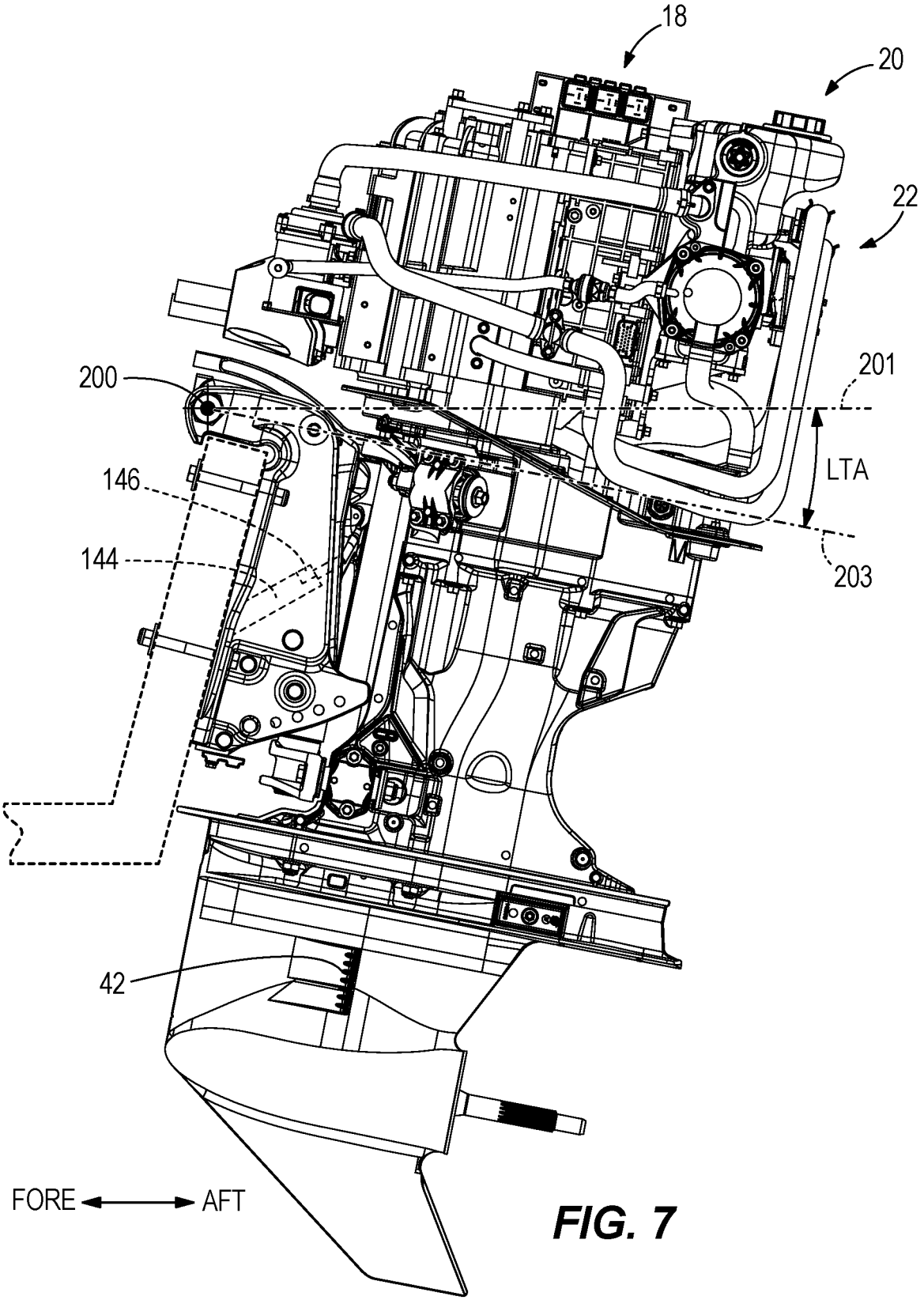
FIG. 7 is a view of a marine drive at a first preset trim angle.

Once the controller 105 has executed the clearance actions, and as long as the operator has not aborted the process, the controller 105 is configured to automatically operate the trim actuator 144 to change a trim angle TA of the marine drive 20 to a first trim angle among a plurality of preset trim angles at step 303. The first trim angle corresponds to the trim angle at which coolant is configured to drain from at least one of the cooling pathways 60 of the marine drive 20 identified above. FIG. 7 shows an example of the marine drive 20 which is trimmed to a first trim angle with respect to the horizontal axis 201. In certain embodiments, the controller 105 is configured to generate a notification before and/or during automatically changing the trim angle of the marine drive 20 to warn the operator of the marine drive 20 moving. In certain embodiments, wherein the marine drive is coupled to a marine vessel, as shown in FIGS. 7-8, the controller 105 is further configured to also determine a vessel angle of the marine vessel and adjust the first trim angle to accommodate for the orientation of the marine drive 20 based upon the vessel angle. In other words, the marine vessel's angle may be taken into account to ensure that the actual angle of the marine drive is as intended during the draining procedure. By way of example, the control system may obtain the vessel angle of the marine vessel via input from an inertial measurement unit (IMU) or an attitude and heading reference system (AHRS) (collectively shown as the IMU/AHRS 62 in FIG. 9). An IMU has state accelerometers and angular rate sensors that sense the vessel's attitude. An AHRS provides 3D orientation of the marine vessel by integrating gyroscopic measurements, accelerometer data, and magnetometer data. If the control system determines that the angle of the marine vessel does not permit the marine drive to be positioned as needed for draining, a notification may be provided for the user. For example, the angle of the marine vessel may be such that the marine drive cannot be tucked far enough to reach all necessary preset trim angles for properly draining the marine drive.

In certain embodiments, the controller 105 is further configured to monitor the change of the trim angle and, in the event that the trim angle stops changing before the marine drive 20 reaches the target trim angle (e.g., the first trim angle) for at least a threshold time, the controller 105 ceases to change the trim angle to prevent damage. In other words, the controller is configured to determine that either a failure has occurred with the trim actuator or an obstruction is preventing the movement of the marine drive. By way of example, the threshold time may be 0.2 second, 0.5 seconds, 1.0 second, or others. A notification may also be provided to the operator to investigate the situation, remove any obstructions, and restart the process. It should be recognized that this safety check is not limited to the first trim angle, but may continue throughout the entire draining process.

With continued reference to FIG. 10, once the trim angle of the marine drive 20 is determined to be equal to the first trim angle stored in memory for that marine drive, the controller 105 is configured to wait a first preset time stored in memory for that first trim angle at step 304, to allow for the cooling water to drain from the marine drive 20. The first preset time can be any range of time which allows for the cooling water to drain from the marine drive. By way of example, the first preset time may be at least 10 seconds, 30 seconds, at least 1 minute, 5 minutes, 10 minutes, or other times.

At step 305, the controller 105 is configured to operate the trim actuators 144 to change the trim angle of the marine drive 20 from the first trim angle to a second trim angle among the plurality of preset trim angles. FIG. 8 shows an example of the marine drive 20 that is trimmed to a second trim angle with respect to the horizontal axis 201. As such, for the purposes of the disclosure, the first trim angle is different than the second trim angle. In certain examples, the first and the second trim angle are both different than the fully trimmed out angle, although this configuration is not limiting. The second trim angle corresponds to the trim angle at which coolant is configured to drain from at least one of the cooling pathways 60 of the marine drive 20, which may be the same or another cooling path as for the first trim angle. In other words, one cooling pathway may require multiple trim angles to cause the water to drain entirely from the marine drive.

As described above in reference to steps 303, 304, the controller 105 is then configured to wait a second preset time at step 306 to allow for the cooling water to drain from the marine drive 20. The controller 105 may be configured to iterate through steps 303, 304 for any number of trim angles and preset times, according to the cooling pathways 60 which need to be drained. For example, the controller 105 may be configured to operate the trim actuators 144 to change the trim angle and wait a preset time to allow for the pooling area of each cooling pathway 60 identified above to drain.

At step 306, the controller 105 is configured to determine if the trim angle is equal to a fully trimmed out angle. If the trim angle is not equal to the fully trimmed out angle, at step 307, the controller 105 is configured to operate the trim actuators 144 to change the trim angle of the marine drive 20 to the fully trimmed out angle for storage. For the purposes of this disclosure, the fully trimmed out angle is a positive angle greater than 2° relative to the horizontal axis 201, as defined above.

Once the marine drive 20 is trimmed to the fully trimmed out angle, the marine drive is ready for storage. By automatically trimming and tucking the marine drive 20 to a plurality of preset trim angles, the pooling areas associated with each of the cooling pathways 60 are drained such that damage to the marine drive 20 is prevented.

In another example, the controller 105 is configured to sequentially change the trim angle of the marine drive to three preset trim angles during an automatic draining procedure, waiting first and second preset times before transitioning out of the first and second of the three preset trim angles, respectively. In this example, once the automatic drain process is initiated, the controller controls the trim actuator to adjust the trim angle of the marine drive to a level trim of approximately 0° (unless already in this position), wait a first preset time of 5 minutes, adjust the trim angle to −14° tuck, wait a second preset time of 1 minute, then adjust the trim angle to 30° trim. The 30° trim may be the fully trimmed out position for the marine drive. The −14° tuck may be the fully tucked position for the marine vessel. Depending on the marine drive, the level trim may be configured to allow the powerhead and the crankcase oil cooler to drain, the −14° tuck may be configured to allow the exhaust sprayer, heads, and blocks, to drain, and the 30° trim may be configured to allow the water pump and driveshaft housing to drain (as well as being a storage angle for the marine drive when not in use).

It should be recognized that the process may be repeated for multiple marine drives simultaneously, or in sequence. The marine drives need not be the same, whereby the controller may control the trim actuators of each marine drive in accordance with that marine drive's particular trim angle needs to effectuate proper draining.

In certain embodiments, if the user chooses a manual draining option on the display, the system responds with a pop-up display stating to "refer to owner's manual," or could display the instructions from the owner's manual as a convenient shortcut.

In certain embodiments, the preset trim angles stored in memory may be provided by or edited by a user, for example to enable the systems and methods disclosed herein to function with any existing marine drive having any particular drainage procedure. For example, the user may program in that their particular marine drive requires 3 different drain angles, or perhaps even a single drain angle that is neither level trim nor full trim, but that the user would like to automate and select a desired time for training at that angle.

In this manner, the presently disclosed systems and methods ensure not only that proper drainage techniques are followed when draining a marine drive, but that the need for doing so is also identified before its too late to prevent damage from cold weather. The systems and methods also eliminate the need for the user to time the drainage at a given trim angle, as well as the need for estimating the actual trim angle in which the marine drive has been positioned. The present inventors have further identified that these systems and methods can advantageously be implemented without any additional hardware, wiring, and the like.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A method for automatically draining a marine drive, the method comprising:

receiving via a controller a request to drain the marine drive, wherein a trim angle of the marine drive is trimmable between a maximum trim angle and a minimum trim angle;

receiving from a memory system a drain profile for the marine drive, the drain profile defining a first trim angle and a second trim angle, and a first preset time and a second preset time corresponding thereto, respectively, for draining the marine drive based on at least one cooling pathway that retains fluid at different trim angles such that draining requires trimming the marine drive in both the first trim angle and the second trim angle, wherein the first trim angle is different than the second trim angle and neither is the maximum trim angle for trimming the marine drive:

automatically trimming the marine drive to the first trim angle within the drain profile;

waiting the first preset time within the drain profile after the marine drive is trimmed to the first trim angle;

automatically trimming the marine drive to the second trim angle within the drain profile after the first preset time has lapsed; and waiting the second preset time within the drain profile after the marine drive is trimmed to the second trim angle, wherein trimming to the first trim angle, waiting the first preset time, trimming to the second trim angle, and waiting the second preset time all responsive to receiving the request provides draining specific to the marine drive based on the one or more particular cooling pathways therein.

2. The method according to claim 1, further comprising generating a notification for an operator to check a clearance of the marine drive before automatically trimming the marine drive to the first trim angle.

3. The method according to claim 1, further comprising generating a notification before and/or during automatically changing the trim angle of the marine drive to warn an operator of the marine drive moving, the notification being other than communicating a measurement of the trim angle itself.

4. The method according to claim 3, wherein the notification comprises audible warnings.

5. The method according to claim 1, further comprising measuring with a sensor whether the marine drive is positioned in water and automatically changing the trim angle thereof after determining that the marine drive is positioned out of the water.

6. The method according to claim 1, wherein the first trim angle is approximately ±2° relative to a horizontal axis, wherein the maximum trim angle is a positive angle greater than 2° relative to the horizontal axis, and wherein the second trim angle is a negative angle less than −2° relative to the horizontal axis.

7. The method according to claim 1, further comprising, after waiting the second preset time after the marine drive is trimmed to the second trim angle, automatically trimming the marine drive to the maximum trim angle for storage.

8. The method according to claim 1, wherein the first trim angle is approximately ±2° relative to a horizontal axis, and the second trim angle is the minimum trim angle and is less than −2° relative to the horizontal axis.

9. The method according to claim 1, wherein the first preset time is at least 1 minute.

10. The method according to claim 1, further comprising monitoring the change of the trim angle and, when the trim angle stops changing before the marine drive reaches the first trim angle for at least a threshold time, ceasing to change the trim angle to prevent damage.

11. The method according to claim 1, wherein the controller is configured to receive the request to drain the marine drive via a single operator input.

12. A method for automatically draining a marine drive at a plurality of preset trim angles less than a fully trimmed out angle, the method comprising:

receiving via a controller a request to drain the marine drive;

operating a trim actuator via the controller to change a trim angle of the marine drive to a first trim angle among the plurality of preset trim angles;

waiting a first preset time after the marine drive is trimmed to the first trim angle; and operating the trim actuator to change the trim angle of the marine drive to a second trim angle among the plurality of preset trim angles that is different than the first trim angle, wherein the marine drive is configured to drain when trimmed at each of the first trim angle and the second trim angle, wherein changing the trim angle to the first trim angle, waiting the first preset time, and changing the trim angle to the second trim angle all responsive to receiving the request prevents operator error and provides consistency in automatically draining the marine drive, wherein the powerhead of the marine drive comprises an internal combustion engine, further comprising cranking the internal combustion engine for a preset crank time and controlling the marine drive to prevent the internal combustion engine from starting while cranking to assist in draining the marine drive.

13. A method for automatically draining a marine drive at a plurality of preset trim angles less than a fully trimmed out angle, the method comprising:

receiving via a controller a request to drain the marine drive;

operating a trim actuator via the controller to change a trim angle of the marine drive to a first trim angle among the plurality of preset trim angles;

waiting a first preset time after the marine drive is trimmed to the first trim angle;

operating the trim actuator to change the trim angle of the marine drive to a second trim angle among the plurality of preset trim angles that is different than the first trim angle, wherein the marine drive is configured to drain when trimmed at each of the first trim angle and the second trim angle, wherein changing the trim angle to the first trim angle, waiting the first preset time, and changing the trim angle to the second trim angle all responsive to receiving the request prevents operator error and provides consistency in automatically draining the marine drive; and detecting that the marine drive is not operating before changing the trim angle to the first trim angle, wherein the powerhead of the marine drive is determined to not be operating by detecting that a key is in an off-position.

14. A method for automatically draining a marine drive at a plurality of preset trim angles less than a fully trimmed out angle, the marine drive being coupled to a marine vessel, the method comprising:

receiving via a controller a request to drain the marine drive;

operating a trim actuator via the controller to change a trim angle of the marine drive to a first trim angle among the plurality of preset trim angles;

waiting a first preset time after the marine drive is trimmed to the first trim angle;

operating the trim actuator to change the trim angle of the marine drive to a second trim angle among the plurality of preset trim angles that is different than the first trim angle, wherein the marine drive is configured to drain when trimmed at each of the first trim angle and the second trim angle, wherein changing the trim angle to the first trim angle, waiting the first preset time, and changing the trim angle to the second trim angle all responsive to receiving the request prevents operator error and provides consistency in automatically draining the marine drive; and detecting via a sensor a vessel angle of the marine vessel and operating the trim actuator to adjust for the vessel angle when changing the trim angle of the marine drive.

* * * * *